US009116450B2

(12) United States Patent
Iio et al.

(10) Patent No.: US 9,116,450 B2
(45) **Date of Patent: *Aug. 25, 2015**

(54) TONER, PRINTED MATERIAL, METHOD OF PREPARING PRINTED MATERIAL AND IMAGE FORMING APPARATUS HAVING VARNISH APPLICATION MEANS

(75) Inventors: Masato Iio, Kanagawa (JP); Kentarou Matsumoto, Tokyo (JP); Shinya Kobayashi, Kanagawa (JP); Akio Tsujita, Kanagawa (JP); Katsuhiro Shinohara, Kanagawa (JP); Tadashi Kasai, Kanagawa (JP); Masakazu Terao, Kanagawa (JP); Tsuyoshi Asami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 295 days.

This patent is subject to a terminal disclaimer.

(21) Appl. No.: 13/236,867

(22) Filed: Sep. 20, 2011

(65) Prior Publication Data

US 2012/0082829 A1 Apr. 5, 2012

(30) Foreign Application Priority Data

Sep. 30, 2010 (JP) ..... 2010-222373

(51) Int. Cl.

| | |
|---|---|
| ***G03G 9/00*** | (2006.01) |
| ***G03G 9/087*** | (2006.01) |
| ***G03G 8/00*** | (2006.01) |
| *G03G 13/16* | (2006.01) |
| *B41J 19/02* | (2006.01) |

(52) U.S. Cl.

CPC ..... *G03G 9/08782* (2013.01); *G03G 8/00* (2013.01); *Y10T 428/24868* (2015.01)

(58) Field of Classification Search

USPC ..... 208/20; 399/265, 341, 343; 428/203; 430/105, 106.2, 106.3, 108.8, 109.1, 430/109.2, 109.5, 111.4, 126.1, 104, 430/124.13; 524/31, 247, 248, 556

See application file for complete search history.

(56) References Cited

U.S. PATENT DOCUMENTS

| | | | | |
|---|---|---|---|---|
| 7,450,870 | B2 | 11/2008 | Iio et al. | |
| 7,561,835 | B2 | 7/2009 | Tanaka et al. | |
| 7,720,418 | B2 | 5/2010 | Tanaka et al. | |
| 7,738,819 | B2 | 6/2010 | Honda et al. | |
| 2004/0208674 | A1 | 10/2004 | Ilo et al. | |
| 2007/0184374 | A1* | 8/2007 | Hirano et al. | 430/108.8 |
| 2007/0224528 | A1 | 9/2007 | Yamashita et al. | |
| 2007/0238813 | A1* | 10/2007 | Anderson et al. | 524/31 |
| 2008/0038653 | A1* | 2/2008 | Yamazaki et al. | 430/106.2 |
| 2008/0038654 | A1 | 2/2008 | Yamazaki et al. | |
| 2008/0138132 | A1* | 6/2008 | Yamashita et al. | 399/343 |

(Continued)

FOREIGN PATENT DOCUMENTS

| | | | |
|---|---|---|---|
| EP | 0 823 670 | A1 | 2/1998 |
| EP | 1 843 212 | A1 | 10/2007 |

(Continued)

OTHER PUBLICATIONS

Search Report issued Jan. 25, 2012 in European Patent Application No. 11181381.2-1217.

*Primary Examiner* — Bijan Ahvazi

(74) *Attorney, Agent, or Firm* — Oblon, McClelland, Maier & Neustadt, L.L.P.

(57) ABSTRACT

A toner including a petroleum wax, wherein the petroleum wax comprises a paraffin wax having a polarity.

12 Claims, 2 Drawing Sheets

(56) References Cited

U.S. PATENT DOCUMENTS

| | | | | |
|---|---|---|---|---|
| 2009/0155710 | A1* | 6/2009 | Aoki et al. | 430/111.4 |
| 2009/0291382 | A1 | 11/2009 | Hirose et al. | |
| 2010/0127491 | A1* | 5/2010 | Scholl et al. | 283/81 |
| 2011/0206429 | A1 | 8/2011 | Terao et al. | |
| 2011/0223527 | A1* | 9/2011 | Iio et al. | 430/105 |

FOREIGN PATENT DOCUMENTS

| | | | | |
|---|---|---|---|---|
| JP | 2522333 | | 5/1996 | |
| JP | 9-22147 | A | 1/1997 | |
| JP | 10-309876 | A | 11/1998 | |
| JP | 2003-255601 | A | 9/2003 | |
| JP | 2004-4693 | A | 1/2004 | |
| JP | 3570853 | | 7/2004 | |
| JP | 2006-84661 | A | 3/2006 | |
| JP | 2006-195040 | A | 7/2006 | |
| JP | 2006-243714 | A | 9/2006 | |
| JP | 2007-277547 | | 10/2007 | |
| JP | 2009-073942 | * | 4/2009 | C09D 4/00 |
| JP | 2009-122283 | A | 6/2009 | |
| JP | 2010-79132 | A | 4/2010 | |

* cited by examiner

EXAMPLE OF NORMAL PARAFFIN

TONER, PRINTED MATERIAL, METHOD OF PREPARING PRINTED MATERIAL AND IMAGE FORMING APPARATUS HAVING VARNISH APPLICATION MEANS

CROSS-REFERENCE TO RELATED APPLICATIONS

This patent application is based on and claims priority pursuant to 35 U.S.C. §119 to Japanese Patent Application No. 2010-222373, filed on Sep. 30, 2010, in the Japanese Patent Office, the entire disclosure of which is hereby incorporated herein by reference.

FIELD OF THE INVENTION

The present invention relates to a toner, a printed material, a method of printed materials and an image forming apparatus having a varnish application means, particularly a toner capable of forming a varnish layer on an image formed by an electrophotographic method, a printed material on which a varnish layer is formed, a method of preparing the printed material and an image forming apparatus having a varnish application means.

BACKGROUND OF THE INVENTION

Images and letters are conventionally formed by printings on cover sheets of brochures and books and used for predetermined purposes. It is desired that the cover sheets of brochures and books are protected with a film according to their applications, e.g., protected from water and contamination, or for having gloss. Methods of protecting the cover sheets include overprint, vinyl coating, press coating, filming, etc. These methods make printed surfaces treated after printed. Among these methods, varnish applications are mostly used to form a protection (film) layer to protect printed surfaces with films.

Meanwhile, information frequently changes, and printers capable of producing variable information, e.g., partially changing the information increase. On-demand printings are used for this, and printings at higher speed are desired.

Electrophotographic and inkjet image forming apparatuses are used for on-demand printings, and the electrophotographic image forming apparatuses using a toner are mostly used to produce printings including images.

The electrophotographic image forming method reproduce an image color by transferring a powdery color material called a toner to a recording material such as papers. A fixer fixing a toner uses a roller, etc., formed of a material having good releasability. In order to further improve separability between the roller and a recording material after the toner is fixed, a large amount of oil is applied to the surface of the roller.

However, when a large amount of oil is applied to the surface of the roller, the recording material is contaminated with the oil. In addition, the fixer needs a space containing the oil and becomes complicated and large, resulting in cost increase.

Therefore, recently, electrophotographic image forming apparatuses have needed oilless mechanism without offset prevention mechanism with silicone oil for the purpose of simplifying the fixer and preventing the oil from influencing images such as oil contaminations and oil stripes. In addition, the oil is not applied to the fixing roller to improve fixability of a toner at from low to high temperatures. Instead, a wax is included in a toner.

Offset printings use some commercially-available varnishes to form protection layers on their printed surfaces. However, when the commercially-available varnishes are used in the electrophotographic image forming apparatuses, the wax included in a toner and the varnish do not match each other.

In order to solve this problem, Japanese published unexamined application No. 2007-277547 discloses a varnish composition and a preparation method thereof improving coatability on a toner layer with a water-based film former excluding ammonium and having a low static surface tension to oil-coated printed materials produced by electrophotographic oil fixing methods.

This prevents the varnish composition from being repelled by a fixing oil from the fixing roller applied all over a printed material due to its low static surface tension when applied thereto.

However, even when the varnish can be coated on a toner image formed of a wax-containing toner without being repelled on a printed material produced by electrophotographic image forming methods using a wax-containing toner, adherence between the varnish layer hardened after coated and the toner image is low, resulting in possible peeling of the varnish layer.

Japanese Patent No. 2522333 discloses electrophotographic image forming methods on metallic containers. Directly or through an electroconductive covering layer, a photoconductive titanium oxide photosensitive layer, a toner image layer and a finishing varnish layer are sequentially layered on a metallic container. However, high-frequency induction heating instead of a fixer including a fixing roller is used to heat metallic containers to fix a toner image thereon, and therefore there is no problem of adherence of a recording material to the fixing roller. A wax is used as a binder such that the toner adheres to the metallic container and is different from a wax preventing a recording material from adhering to the fixing roller.

Because of these reasons, a need exists for a wax-containing toner forming a toner image on which a varnish layer having a practical adhesion strength and glossiness for long periods can be formed.

SUMMARY OF THE INVENTION

Accordingly, an object of the present invention is to provide a wax-containing toner forming a toner image on which a varnish layer having a practical adhesion strength and glossiness for long periods can be formed.

Another object of the present invention is to provide a printed material on which a toner and a varnish adhere to each other well.

This object and other objects of the present invention, either individually or collectively, have been satisfied by the discovery of a toner comprising a petroleum wax, wherein the petroleum wax comprises a paraffin wax having a polarity.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a wax-containing toner forming a toner image on which a varnish layer having a practical adhesion strength and glossiness for long periods can be formed.

More particularly, the present invention relates to a toner comprising a petroleum wax, wherein the petroleum wax comprises a paraffin wax having a polarity.

The toner of the present invention includes a wax. The wax is preferably a petroleum wax having high releasability.

A paraffin wax having a polarity is used as the petroleum wax in the present invention.

The paraffin wax having a polarity includes at least one isoparaffin wax or one cycloparaffin.

Figure 1:
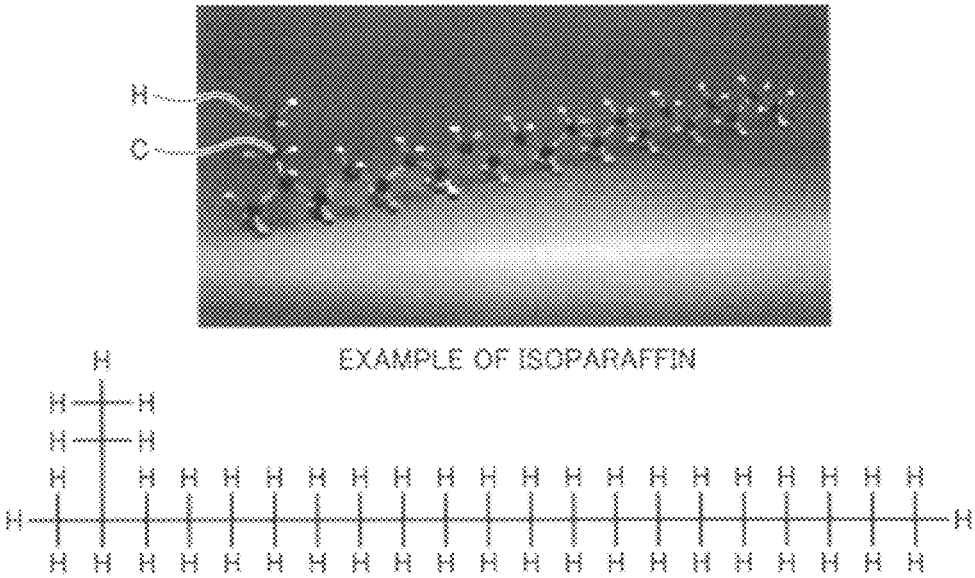
FIG. 1 is a structural embodiment of isoparaffin.
Figure 2:
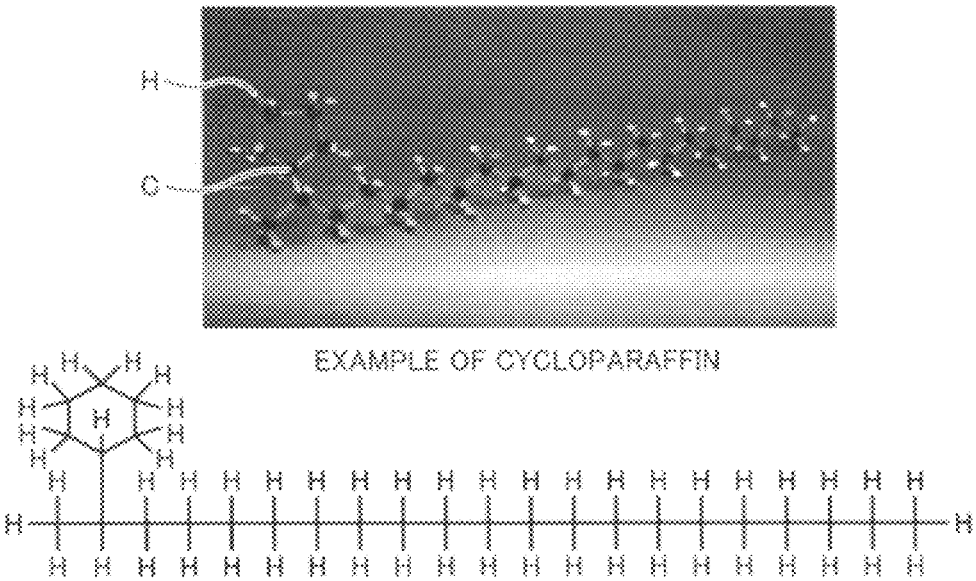
FIG. 2 is a structural embodiment of cycloparaffin.
Figure 3:
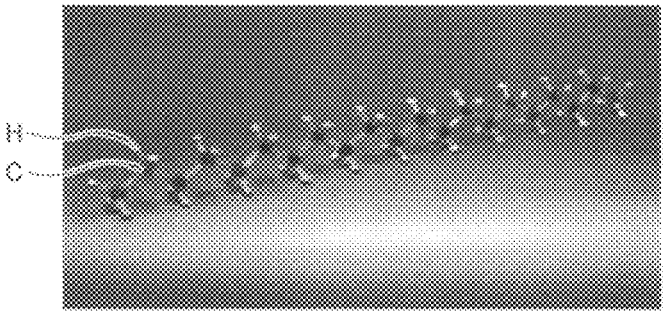
FIG. 3 is a structural embodiment of normal paraffin.
Figure 3:
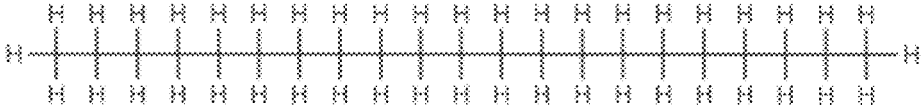

Structural embodiments of the isoparaffin and the cycloparaffin included in a toner are shown in FIGS. 1 and 2, respectively, compared with an embodiment of normal paraffin. The normal paraffin is a compound having a straight-chain structure. On the contrary, each of the isoparaffin in FIG. 1 and the cycloparaffin in FIG. 2 is a compound having a branched-chain structure. The normal paraffin is a compound having a straight-chain structure in FIG. 3 has less molecular bias and small polarity. Each of the isoparaffin and the cycloparaffin for use in the present invention is a compound having a branched-chain structure and has a molecular bias. Therefore, each of the compounds has a polarity higher than that of the normal paraffin having an equivalent molecular weight. A varnish coated on a toner image formed of a toner including a paraffin having a polarity higher than that of normal paraffin having a straight-chain structure in an amount not less than a predetermined amount improves in wettability. When the paraffin having that polarity has a molecular weight close to that of a resin included in the varnish, the wettability further improves and adherence between the varnish layer formed by the hardened varnish and toner image increases. The isoparaffin or the cycloparaffin preferably has an average molecular weight not less than 500.

As FIG. 1 shows, the isoparaffin is a paraffin in which an alkyl group such as methyl groups and ethyl groups is bonded with a carbon besides carbons at an α or a ω site (both ends of a main chain of the paraffin) of a main chain as a side chain. However, the number of carbon atoms of the alkyl group is not greater than that thereof from a carbon atom the alkyl group is bonded with to a carbon at the α or the ω site.

As FIG. 2 shows, the cycloparaffin is a compound having a branched-chain structure and a monovalent cyclized alkylene group having three or more carbon atoms as a side chain.

Each of the isoparaffin and the cycloparaffin has only to have a branched-chain structure, and may have the branched-chain at any site. In addition, the isoparaffin and the cycloparaffin may have the same or different molecular weight from each other. Even when they have the same molecular weight, they can include an isomer at a different branched site. These can be used alone or in combination.

The toner of the present invention preferably includes a petroleum wax in an amount of from 0 to 40% by weight, more preferably from 1 to 40% by weight, and furthermore preferably from 3 to 30% by weight.

The petroleum wax includes the isoparaffin(s) or cycloparaffin(s) in an amount not less than a predetermined amount, e.g., not less than 10% by weight.

The petroleum wax can further include a microcrystalline wax.

The petroleum wax preferably has a melting point of from 40 to 160° C., and more preferably from 50 to 120° C. When less than 40° C., the resultant toner occasionally deteriorates in heat-resistant preservability. When higher than 160° C., the resultant toner occasionally has cold offset when fixed at low temperature.

The wax included in the toner preferably has a melt viscosity of from 5 to 1,000 cps, and more preferably from 10 to 100 cps at a temperature 20° C. higher than the melting point. When greater than 1,000 cps, the resultant toner occasionally deteriorates in hot offset resistance and low-temperature fixability.

The % by weight and average molecular weight of the isoparaffin or cycloparaffin can be measured by FD (Field Desorption) method using JMS-T100GC from JEOL Ltd.

The toner of the present invention includes the petroleum wax and a binder resin as essential components. Besides, the toner of the present invention can include a colorant, a charge controlling agent, a surfactant, etc. These components and methods of preparing the toner will be explained later.

The toner of the present invention preferably has an average circularity, i.e., an average of circularity SR determined by the following formula 1, of from 0.93 to 1.00, and more preferably from 0.95 to 0.99.

Circularity *SR*=(a peripheral length of a circle having an area equivalent to that of a projected area of a toner particle)/(a peripheral length of a projected image of the toner particle) <Formula 1>

The average circularity is an index of the level of concavities and convexities of the toner particle. The closer a toner to a true sphere, the closer the SR to 1.00. The more complicated the surface of the circle, the less the SR.

When the toner has an average circularity of from 0.93 to 1.00, the toner has smooth surface and has good transferability because of having a small contact area with another toner or a photoreceptor. Since the toner has no corner, a developer including the toner is stably stirred in the image developer to prevent production of abnormal images, a pressure is evenly applied to the toner when transferred onto the transfer medium to prevent production of hollow images, and the toner does not scratch or abrades the surface of a photoreceptor.

The circularity is measured with flow-type particle image analyzer FPIA-1000 from SYSMEX CORP. A measurement liquid was prepared by the following method and set therein:

0.1 to 0.5 ml of a surfactant (alkylbenzenesulfonate salt) was added to 100 to 150 ml of water impurities were ready removed from as a dispersant to prepare an aqueous solution;

adding 0.1 to 0.5 g of a measurement sample thereto; and dispersing the aqueous solution with an ultrasonic disperser for 1 to 3 min to prepare a measurement liquid including 3,000 to 10,000 pieces/μl.

In addition to the circularity, the toner preferably has a weight-average particle diameter D4 of from 3 to 10 μm. Having sufficiently small particle diameter, the toner has good dot reproducibility of microscopic latent dots. When less than 3 μm, the transferability and cleanability of the toner deteriorates. When greater than 10 μm, it is difficult to prevent letters and lines from scattering.

Further, the toner preferably has a ratio (D4/D1) of the weight-average particle diameter D4 to a number-average particle diameter D1 of from 1.00 to 1.40. The closer to 1.00, the sharper the particle diameter distribution the toner has.

Therefore, the toner having the ratio of from 1.00 to 1.40 produces stable-quality images. The toner has a sharp friction charged quantity distribution as well to prevent production of foggy images. Further, a toner having a uniform particle diameter has good dot reproducibility because the toner is precisely and orderly developed on a latent dot.

The particle diameter distribution of a toner can be measured by a Coulter counter TA-II or Coulter Multisizer II from Coulter Electronics, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

Any known polymerization or mechanical dispersion methods can be used to prepare the toner of the present invention. A preferred polymerization method is explained.

The almost spherical toner is preferably prepared by crosslinking and/or elongating a toner composition including a polyester prepolymer having a functional group including a nitrogen atom, polyester, a colorant and a petroleum wax as a release agent in an aqueous medium under the presence of a particulate resin. The thus prepared toner has a hardened surface to decrease hot offset contaminating the fixer.

Prepolymers formed of modified polyester resins used for preparing a toner include polyester prepolymers having an isocyanate group (A), and compounds elongatable or crosslinkable with the prepolymer include amines (B).

The polyester prepolymer having an isocyanate group (A) is formed from a reaction between polyester having an active hydrogen atom formed by polycondensation between a polyol (1) and a polycarboxylic acid (2), and polyisocyanate (3). Specific examples of the groups including the active hydrogen include a hydroxyl group (such as an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyols having 3 valences or more (1-2) can be used, and (1-1) alone or a mixture of (1-1) and a small amount of (1-2) are preferably used.

Specific examples of diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, an alkylene glycol having 2 to 12 carbon atoms and adducts of bisphenol with an alkylene oxide are preferably used, and a mixture thereof is more preferably used.

Specific examples of the polyol having 3 valences or more (1-2) include multivalent aliphatic alcohols having 3 to 8 or more valences such as glycerin, trimethylolethane, trimethylolpropane, pentaerythritol and sorbitol; phenols having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acids (2-1) and polycarboxylic acids having 3 or more valences (2-2) can be used. (2-1) alone, or a mixture of (2-1) and a small amount of (2-2) are preferably used.

Specific examples of the dicarboxylic acid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylene dicarboxylic acid having 4 to 20 carbon atoms and an aromatic dicarboxylic acid having 8 to 20 carbon atoms are preferably used.

Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between one or more of the polyols (1) and an anhydride or lower alkyl ester of one or more of the above-mentioned acids. Suitable preferred lower alkyl esters include, but are not limited to, methyl esters, ethyl esters and isopropyl esters.

The polyol (1) and polycarboxylic acid (2) are mixed such that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocyanates such as tolylenedisocyanate and diphenylmethanediisocyanate; aromatic aliphatic diisocyanates such as α,α,α',α'-tetramethylxylylenediisocyanate; isocyanurates; the above-mentioned polyisocyanates blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates.

A content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, the hot offset resistance of the resultant toner deteriorates, and in addition, the heat resistance and low-temperature fixability of the toner also deteriorate. In contrast, when the content is greater than 40% by weight, the low-temperature fixability of the resultant toner occasionally deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the urea-modified polyester decreases and hot offset resistance of the resultant toner occasionally deteriorates.

Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked. Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophoronediamine; aliphatic diamines such as ethylene diamine, tetramethylene diamine and hexamethylene diamine, etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine (B1) is mixed with a small amount of a polyamine (B2) are preferably used.

The molecular weight of the urea-modified polyesters can optionally be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, the molecular weight of the urea-modified polyester (i) decreases, resulting in deterioration of hot offset resistance of the resultant toner.

The urea-modified polyester (i) may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner occasionally deteriorates.

The urea-modified polyester (i) can be prepared by a method such as a one-shot method or a prepolymer method. The weight-average molecular weight of the urea-modified polyester (i) is not less than 10,000, preferably from 20,000 to 10,000,000 and more preferably from 30,000 to 1,000,000. When the weight-average molecular weight is less than 10,000, hot offset resistance of the resultant toner deteriorates.

The number-average molecular weight of the urea-modified polyester is not particularly limited when the after-mentioned unmodified polyester resin (ii) is used in combination. Namely, the weight-average molecular weight of the urea-modified polyester (i) has priority over the number-average molecular weight thereof when combined with an unmodified polyester (ii) mentioned later. However, when the urea-modified polyester (i) is used alone, the number-average molecular weight is not greater than 20,000, preferably from 1,000 to 10,000 and more preferably from 2,000 to 8,000. When the number-average molecular weight is greater than 20,000, the low temperature fixability of the resultant toner deteriorates, and in addition the glossiness of full color images occasionally deteriorates.

In the present invention, an unmodified polyester resin (ii) can be used in combination with the urea-modified polyester resin (i) as a toner binder resin. It is more preferable to use the unmodified polyester resin (ii) in combination with the modified polyester resin than to use the urea-modified polyester resin alone because low-temperature fixability and glossiness of full color images of the resultant toner improve. Specific examples of the unmodified polyester resin (ii) include polycondensated products between the polyol (1) and polycarboxylic acid (2) similarly to the urea-modified polyester resin (i), and the components preferably used are the same as those thereof. It is preferable that the urea-modified polyester resin (i) and unmodified polyester resin (ii) are partially soluble with each other in terms of the low-temperature fixability and hot offset resistance of the resultant toner.

Therefore, the urea-modified polyester resin (i) and unmodified polyester resin (ii) preferably have similar compositions. When the unmodified polyester resin (ii) is used in combination, a weight ratio ((i)/(ii)) between the urea-modified polyester resin (i) and unmodified polyester resin (ii) is from 5/95 to 80/20, preferably from 5/95 to 30/70, more preferably from 5/95 to 25/75, and most preferably from 7/93 to 20/80. When the urea-modified polyester resin (i) has a weight ratio less than 5%, the resultant toner has poor hot offset resistance, and occasionally has difficulty in having heat-resistant preservability and low-temperature fixability.

The unmodified polyester resin (ii) preferably has a peak molecular weight of from 1,000 to 20,000, preferably from 1,500 to 10,000, and more preferably from 2,000 to 8,000. When less than 1,000, the heat-resistant preservability of the resultant toner deteriorates. When greater than 10,000, the low-temperature fixability thereof deteriorates. The unmodified polyester resin (ii) preferably has a hydroxyl value not less than 5 mg KOH/g, more preferably of from 10 to 120 mg KOH/g, and most preferably from 20 to 80 mg KOH/g. When less than 5 mg KOH/g, the resultant toner has difficulty in having heat-resistant preservability and low-temperature fixability. The unmodified polyester resin (ii) has an acid value of from 1 to 30 mg KOH/g, and more preferably from 5 to 20 mg KOH/g such that the resultant toner tends to be negatively charged.

The binder resin preferably has a glass transition temperature (Tg) of from 50 to 70° C., and more preferably from 55 to 65° C. When less than 50° C., a heat-resistant preservability of the resultant toner deteriorates. When greater than 70° C., a low-temperature fixability thereof is insufficient. A dry toner including the unmodified polyester resin (ii) and the urea-modified polyester resin (i) has a better heat-resistant preservability than known polyester toners even though the glass transition temperature is low.

The binder resin preferably has a temperature at which a storage modulus of the toner binder resin is 10,000 dyne/cm$^2$ at a measuring frequency of 20 Hz(TG'), of not less than 100° C., and more preferably of from 110 to 200° C. When less than 100° C., the hot offset resistance of the resultant toner deteriorates.

The toner binder resin preferably has a temperature at which the viscosity is 1,000 poise (Tη), of not greater than 180° C., and more preferably of from 90 to 160° C. When greater than 180° C., the low-temperature fixability of the resultant toner deteriorates. Namely, TG' is preferably higher than Tη in terms of the low-temperature fixability and hot offset resistance of the resultant toner. In other words, the difference between TG' and Tη (TG'−Tη) is preferably not less than 0° C., more preferably not less than 10° C., and furthermore preferably not less than 20° C. The maximum of the difference is not particularly limited. In terms of the heat-resistant preservability and low-temperature fixability of the resultant toner, the difference between TG' and Tη (TG'−Tη) is preferably from 0 to 100° C., more preferably from 10 to 90° C., and most preferably from 20 to 80° C.

The binder resin can be prepared, for example, by the following method.

The polyol (1) and polycarboxylic acid (2) are heated at a temperature of from 150 to 280° C. in the presence of a known catalyst such as tetrabutoxy titanate and dibutyltinoxide. Then, water generated is removed, under a reduced pressure if desired, to prepare a polyester resin having a hydroxyl group. Then the polyester resin is reacted with the polyisocyanate (3) at a temperature of from 40 to 140° C. to prepare a prepolymer having an isocyanate group (A). Further, the prepolymer (A) is reacted with an amine (B) at a temperature of from 0 to 140° C. to prepare a urea-modified polyester. When (3), and (A) and (B) are reacted, a solvent can be used if desired.

Suitable solvents include solvents which do not react with polyisocyanate (3). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

When the unmodified polyester (ii) is used in combination with the urea-modified polyester (i), a method similar to a method for preparing a polyester resin having a hydroxyl group is used to prepare the unmodified polyester (ii), and which dissolved and mixed in a solution after a reaction of the urea-modified polyester (i) is completed.

The toner for use in the present invention can be prepared by, but is not limited to, the following method.

The toner may be prepared by reacting a dispersion including the prepolymer having an isocyanate group (A) with the amine (B) in an aqueous medium, or may use a previously-prepared urea-modified polyester (i). As a method of stably preparing a dispersion formed of the prepolymer (A) and the unmodified polyester resin (ii) in an aqueous medium, a method of including a toner constituent formed of the prepolymer (A) and the unmodified polyester resin (ii) into an aqueous medium and dispersing them upon application of shear stress is preferably used.

The prepolymer (A), the unmodified polyester resin (ii) and other_toner constituents (hereinafter referred to as toner materials) such as colorants, master batch pigments, release agents and charge controlling agents, etc. may be added into an aqueous medium at the same time when the dispersion is prepared. However, it is preferable that the toner materials are previously mixed, and then are added to the aqueous medium. In addition, other toner materials such as colorants, release agents, charge controlling agents, etc., are not necessarily added to the aqueous dispersion before particles are formed, and may be added thereto after particles are prepared in the aqueous medium. For example, after forming particles without a colorant, a colorant can also be added thereto by known dying methods.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

A content of the aqueous medium to 100 parts by weight of the toner constituent including the prepolymer (A) and the unmodified polyester resin (ii) or is typically from 50 to 2,000 parts by weight, and preferably from 100 to 1,000 parts by weight. When the content is less than 50 parts by weight, the dispersion of the toner constituent in the aqueous medium is not satisfactory, and thereby the resultant mother toner particles do not have a desired particle diameter. In contrast, when the content is greater than 2,000, the production cost increases.

A dispersant can preferably be used to prepare a stably dispersed dispersion including particles having a sharp particle diameter distribution.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μM can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 min. The temperature in the dispersion process is typically from 0 to 150° C. (under pressure), and preferably from 40 to 98° C. When the temperature is relatively high, the modified polyester (i) or prepolymer (A) can easily be dispersed because the dispersion formed thereof has a low viscosity.

The urea-modified polyester (i) may be prepared from the prepolymer (A) by adding amines (B) in the aqueous medium before or after the toner constituent is dispersed therein. The urea-modified polyester is preferentially formed on the surface of the resultant toner, and which can have a gradient of concentration thereof inside.

In the above-mentioned reaction, a dispersant is preferably used when necessary.

The dispersant is not particularly limited, and surfactants, poor-water-soluble inorganic compound dispersants, polymeric protective colloid, etc. can be used. These can be used alone or in combination. Among these, the surfactants are preferably used.

The surfactants include anionic surfactants, cationic surfactants, nonionic surfactants, ampholytic surfactants, etc.

Specific of the anionic surfactants include alkylbenzene sulfonic acid salts, α-olefin sulfonic acid salts, ester phosphate, etc., and they preferably include a fluoroalkyl group. Specific examples of the anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc. Specific examples of the marketed products of such surfactants having a fluoroalkyl group include SURFLON 5-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants include amine salts such as alkyl amine salts, aminoalcohol fatty acid derivatives, polyamine fatty acid derivatives and imidazoline, and quaternary ammonium salts such as alkyltrimethyl ammonium salts, dialkyldimethyl ammonium salts, alkyldimethyl benzyl ammonium salts, pyridinium salts, alkyl isoquinolinium salts and benzethonium chloride. Among the cationic surfactants, primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. are preferably used. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of the nonionic surfactants include fatty acid amide derivatives, polyhydric alcohol derivatives, etc.

Specific examples of the ampholytic surfactants include as alanine, dodecyldi(aminoethyl)glycin, di(octylaminoethyle) glycin, and N-alkyl-N,N-dimethylammonium betaine.

Specific examples of the poor-water-soluble inorganic compound dispersants include tricalcium phosphate, calcium carbonate, titanium oxide, colloidal silica and hydroxyapatite, etc.

Specific examples of the polymeric protective colloid include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersion stabilizer, the calcium phosphate is dissolved with an acid such as a hydrochloric acid and washed with water to remove the calcium phosphate from the toner particle.

In the elongation or crosslinking reactions, catalysts such as dibutyltinlaurate and dioctyltinlaurate can be used.

Further, to decrease viscosity of a dispersion medium including the toner constituent, a solvent which can dissolve the prepolymer (A) and a urea-modified polyester resin (i) can be used because the resultant particles have a sharp particle diameter distribution. The solvent is preferably volatile from the viewpoint of being easily removed from the dispersion after the particles are formed.

Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The usage of such solvents is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the prepolymer.

The elongation and/or crosslinking reaction time depend on reactivity of the isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising the temperature of the whole dispersion to completely remove the organic solvent in the droplet by vaporizing can be used. Otherwise, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. The powder remaining after the dispersion liquid is dried can be classified, but the liquid is preferably classified in terms of efficiency. Unnecessary fine and coarse particles can be recycled to a kneading process to form particles.

The fine and coarse particles may be wet when recycled. The dispersant is preferably removed from the dispersion liquid, and more preferably removed at the same time when the above-mentioned classification is performed.

Heterogeneous particles such as release agent particles, charge controlling particles, fluidizing particles and colorant particles can be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

Known pigments and dyes having been used as colorants for toners can be used as colorants for use in the electrophotographic toner of the present invention. Specific examples of the colorants include carbon black, lamp black, iron black, cobalt blue, nigrosin dyes, aniline blue, phthalocyanine blue, phthalocyanine green, Hansa Yellow G, Rhodamine 6C Lake, chalco oil blue, chrome yellow, quinacridone red, benzidine yellow, rose Bengal, etc. These can be used alone or in combination.

Further, to optionally impart magnetism to toner particles, magnetic components, i.e., iron oxides such as ferrite, magnetite and maghemite; metals such as iron, cobalt and nickel; or their alloyed metals with other metals are included in toner particles alone or in combination. In addition, these components can be used as colorants or with colorants.

The colorant in the toner of the present invention preferably has a number-average particle diameter not greater than 0.5 μm, more preferably not greater than 0.4 μm, and furthermore preferably not greater than 0.3 μm. When greater than 0.5 μm, the colorant does not have a sufficient dispersibility and the resultant toner does not have desired transparency. The colorant having a particle diameter less than 0.1 μm is basically considered not to have an adverse effect on light reflection and absorption of the resultant toner. The colorant having a particle diameter less than 0.1 μm contributes to transparency of an OHP sheet having good color reproducibility and image fixability. To the contrary, a large number of the colorants having a particle diameter greater than 0.5 μm tend to essentially deteriorate brightness and chromaticness of a projected image on an OHP sheet. Meanwhile, a large number of the colorants having a particle diameter greater than 0.5 μm are released from a surface of the toner particle, and tend to cause various problems such as background development, drum contamination and poor cleaning. The colorant having a number-average particle diameter not less than 0.7 μm is preferably not greater than 5% by number.

When the colorant is previously kneaded with a part or all of binder resins under the presence of a wetter, the colorant and the binder resins sufficiently adhere to each other and the colorant is effectively and stably dispersed even after any production process. The resultant toner includes well dispersed colorant, a small dispersion diameter thereof and has good transparency.

Specific examples of the binder resin include, but are not limited to, the modified and unmodified polyester resins mentioned above.

Specific examples of the method of previously kneading a mixture of the binder resin and the colorant with the wetter include a method of mixing the binder resin, the colorant and the wetter by a blender such as Henschel mixers; and kneading the mixture by a kneader such as two-roll and three-roll mills at a lower temperature than a melting point of the binder resin.

Specific examples of the wetter include typical organic solvents in consideration of solubility with the binder resin and wettability of the colorant. Particularly, organic solvents such as acetone, toluene, butanone or water are preferably used in terms of dispersibility of the colorant. Water is most preferably used in terms of environmental protection and the dispersion stability of the colorant in the following process of preparing a toner.

The method not only makes the colorant have a small particle diameter nut also increase uniformity of the dispersion status thereof, and which improves color reproducibility of images projected by OHP more.

The toner may include a charge controlling agent to obtain sufficient charge quantity and improve charge buildability. Materials almost colorless or white are preferably used because colored materials cause a color change of the resultant toner. Specific examples of the charge controlling agent include known charge controlling agents such as triphenylmethane dyes, chelate compounds of molybdic acid, Rhodamine dyes, alkoxyamines, quaternary ammonium salts (including fluorine-modified quaternary ammonium salts), alkylamides, phosphor or compounds including phosphor, tungsten or compounds including tungsten, fluorine-containing activators, metal salts of salicylic acid, salicylic acid derivatives, etc. Specific examples of the marketed products of the charge controlling agents include BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images. These charge controlling agent can be dissolved and dispersed after kneaded upon application of heat together with a master batch pigment and resin, can be added when directly dissolved and dispersed in an organic solvent or can be fixed on a toner surface after the toner particles are produced.

Particulate resins may be added an aqueous medium when toner constituents are dispersed therein to stabilize the dispersibility.

Any thermoplastic and thermosetting resins can be used provided they can form an aqueous medium. Specific examples of the resins include vinyl resins, polyurethane resins, epoxy resins, polyester resins, polyamide resins, polyimide resins, silicon resins, phenol resins, melamine resins, urea resins, aniline resins, ionomer resins and polycarbonate resins. These resins can be used in combination. Among these resins, vinyl resins, polyurethane resins, epoxy resins, polyester resins and their combinations are preferably used because an aqueous medium including spherical particulate resins can easily be formed.

Specific examples of the vinyl resins include, but are not limited to, polymers formed of homopolymerized or copolymerized vinyl monomers such as styrene-(metha)esteracrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers.

As an external additive for improving fluidity, developability and chargeability of the colored particles of the present invention, inorganic particulate materials are preferably used.

Specific examples of the inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The inorganic particulate materials preferably have a primary particle diameter of from 5 nm to 2 μm, and more preferably from 5 nm to 500 nm. In addition, a specific surface area of the inorganic particulate materials measured by a BET method is preferably from 20 to 500 $m^2/g$. The content of the external additive is preferably from 0.01 to 5% by weight, and more preferably from 0.01 to 2.0% by weight, based on total weight of the toner composition.

Other than these materials, particulate polymers such as polystyrene formed by a soap-free emulsifying polymerization, a suspension polymerization or a dispersing polymerization, estermethacrylate or esteracrylate copolymers, silicone resins, benzoguanamine resins, polycondensation particulate materials such as nylon and polymer particles of thermosetting resins can be used.

The toner may include a fluidizer, i.e., surface treatment agents can increase hydrophobicity and prevent deterioration of fluidity and chargeability of the resultant toner even in high humidity. Specific examples of the surface treatment agents include silane coupling agents, sililating agents, silane coupling agents having an alkyl fluoride group, organic titanate coupling agents, aluminium coupling agents silicone oils and modified silicone oils.

In addition, the toner may include a cleanability improver for removing a developer remaining on a photoreceptor and an intermediate transfer medium after transferred. Specific examples of the cleanability improver include fatty acid metallic salts such as zinc stearate, calcium stearate and stearic acid; and particulate polymers prepared by a soap-free emulsifying polymerization method such as particulate polymethylmethacrylate and particulate polystyrene. The particulate polymers comparatively have a narrow particle diameter distribution and preferably have a volume-average particle diameter of from 0.01 to 1 μm.

The toner has good developing stability and produces high-quality toner images.

In addition, the image forming apparatus of the present invention can use an amorphous toner prepared by pulverization methods as well besides the polymerization toner. Constituents forming the toner prepared by the pulverization methods include those typically used in the electrophotographic toners without a particular limit.

Specific examples of binder resin for use in the toner prepared by pulverization methods include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; acrylic ester polymers and copolymers such as polymethylacrylate, polybutylacrylate, polymethylmethacrylate and polybutylmethacrylate; polyvinyl derivatives such as polyvinylchloride and polyvinylacetate; polyester polymers; polyurethane polymers; polyamide polymers; polyimide polymers; polyol polymers; epoxy polymers; terpene polymers; aliphatic or alicycle hydrocarbon resins; aromatic petroleum resins; etc. These can be used alone or in combination, but the resins are not limited thereto. Among these resins, at least a resin selected from the group consisting of styrene-acrylic copolymer resins, polyester resins and polyol resins is preferably used to impart good electric properties to the resultant toner and decrease production cost thereof. Further, the polyester resins and/or the polyol resins are more preferably used to impart good fixability to the resultant toner.

The toner prepared by the pulverization methods can be prepared by pre-mixing the colorant, wax, charge controlling agent with the resin when necessary to prepare a mixture, kneading the mixture at a temperature not higher than a melting point of the resin to prepare a kneaded mixture, cooling the kneaded mixture to prepare a hardened mixture and pulverizing the a hardened mixture. In addition, the external additives may be added to the toner when necessary.

After a toner image is formed by an electrophotographic image forming apparatus with the toner of the present invention, the toner image is varnished to form a varnish layer.

Preferred embodiment of the varnish for use in the present invention is explained.

Varnishes capable of forming a varnish layer on a toner image formed with the toner of the present invention are not particularly limited.

The varnish includes at least one surfactant before coated. The varnish improves in wettability with the toner image and the varnish layer is less rejected on the toner image.

The surfactants include anion surfactants, nonion surfactants, silicone surfactants and fluoro surfactants.

Specific examples of the anion surfactants include sulfosuccinate, disulfonate, phosphate, phosphate, sulfate, sulfonate, and their mixtures.

Specific examples of the nonion surfactants include polyvinylalcohol, polyacrylate, isopropyl alcohol, acetylene diols, ethoxylated octylphenol, ethoxylated and branched secondary alcohol, perfluorobutane sulfonate, alkoxylated alcohol, etc.

Specific examples of the silicone surfactants include polyether decorated polydimethylsiloxane, etc.

Specific examples of the fluoro surfactants include $F(CF_2CF_2)_m(CH_2CH_2O)_nH$, wherein m is from 1 to 7 and n is from 1 to 5, ethoxylated nonylphenol, etc.

The surfactant imparts absorbability to an interface between the toner and the varnish, and the varnish decreases in surface tension an improves in wettability with the toner image.

The varnish usable in the present invention include aqueous varnishes, oil varnishes, and light curing varnishes.

The aqueous varnish or the oil varnish includes water or an organic solvent as a solvent or a dispersant.

In addition, the aqueous varnish or the oil varnish includes a resin and other additives.

The resin includes natural resins and synthetic resins.

Specific examples of the natural resins include, but are not limited to, pine resins, ester gums, shellac petroleum resins, coumarone resins, pitches, etc. In addition, partially modified natural resins such as soluble nitrocellulose and acetyl cellulose can also be used.

Specific examples of the synthetic resins include, but are not limited to, alkyd resins, acrylic resins, amino resins, epoxy resins, urethane resins, silicon resins, fluorine-containing resins, etc.

Besides these resins, chlorinated rubbers and cyclized rubbers can also be used.

The aqueous varnish or the oil varnish includes these natural resins and synthetic resins as a main component.

The aqueous varnish or the oil varnish may include an organic solvent.

Specific examples of the solvent include ether solvents such as ethyleneglycolmonoethylether; ester solvents such as ethyl acetate, butyl acetate and amine acetate; ketone solvents such as acetone, methyl ethyl ketone (MEK) and methyl isobutyl ketone (MIBK); alcohol solvents such as ethanol, butanol and isopropanol; alicyclic hydrocarbons such as mineral spirits; and aromatic hydrocarbons such as xylene, toluene, benzene and solvent naphtha. These can be used as a viscosity conditioner when varnishing.

The oil varnish may include an oil such as linseed oils, soy oils, safflower oils and wood oils as an organic solvent or a curing agent.

The aqueous varnish or the oil varnish may include other additives such as plasticizers, leveling agents and antisettling agents used in known paints.

The light curing varnish is preferably used because of not including a solvent having an affect on the human body, and being quick is curing and highly productive. The light curing varnish is basically formed of at least one of a reactive oligomer or a reactive monomer, and other materials such as photopolymerization initiators, sensitizers, surfactants and additives.

Specific examples of the reactive oligomer or the reactive monomer include polyols such as esteracrylate, epoxyacrylate, urethaneacrylate, polyetheracrylate, polyetheracrylate, alkydacrylate and melamineacrylate. These can be used alone or in combination.

In addition, a crosslinkable monomer, e.g., polyacrylate such as diacrylate and triacrylate having two or more acrylic groups may be added to the reactive oligomer or the reactive monomer in a small amount. These can be used alone or in combination.

Specific examples of the photopolymerization initiator include acetophenone-based or ketal-based photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime, benzoin ether-based photopolymerization initiators such as benzoin, benzoin methyl ether, benzoin ethyl ether, benzoin isobutyl ether, and benzoin isopropyl ether, benzophenone-based photopolymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoylbenzene, thioxanthone-based photopolymerization initiators such as 2-isopropylthioxanthone, 2-chlorothioxanthone, 2,4-dimethylthioxanthone, 2,4-diethylthioxanthone, and 2,4-dichlorothioxanthone and, additional other photopolymerization initiators such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methyl phenyl glyoxy ester, 9,10-phenanthrene, acridine-based compound, triazine-based compound, and imidazole-based compound. Further, a material having a photopolymerization promoting effect can be used alone or in combination with the above-mentioned photopolymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

These polymerization initiators can be used alone or in combination. The content thereof is preferably from 0.5 to 40 parts by weight, and more preferably from 1 to 20 parts by weight per 100 parts by weight of the total inclusion material having radical polymerizability.

Specific examples of the sensitizer include anthraquinone, benzophenone, 2-ethylanthraquinone, etc.

The above-mentioned surfactants can be used.

Specific examples of the additive include leveling additives, matting agents, waxes controlling film properties, and tackifier not impairing polymerization to improve adherence to recording materials such as polyolefin and PET.

The varnish coated on a toner image is dried by drying methods mentioned later. Thus, a varnish layer is formed on the toner image. The image forming apparatus of the present invention applies a varnish on a toner image in the form of a layer with an applicator after forming the toner image. The applicator can include a varnish drier and a varnish curer.

When the aqueous varnish or the oil varnish is used to form a varnish layer, a moisture or a solvent included in the varnish is dried by blowing, and the varnish is dried by heating and blowing. The varnish is heated by hot water or hot oil, and further, by infrared.

Specific examples of the light curers include light sources such as low-pressure mercury lamps, middle-pressure mercury lamps, high-pressure mercury lamps, ultrahigh-pressure mercury lamps, xenon lamps, carbon-arc lamps, metal halide lamps, fluorescent lamps, tungsten lamps, argon ion lasers, helium cadmium lasers, helium neon lasers, krypton ion lasers, laser diodes, YAG lasers, light emitting diodes, CRT light sources, plasma light sources, electron beams, γ beams, ArF excimer lasers, KrF excimer lasers and $F_2$ lasers. These light sources cure a varnish coated on a toner image to form a varnish layer. These can be separated from applicators in image forming apparatus mentioned later, but are preferably equipped in the applicators.

Next, the printed material of the present invention is explained.

A varnish layer of the above-mentioned varnish is formed on at least a part of a toner image formed of the toner of the present invention on a substrate of the printed material of the present invention, The substrates are sheet-shaped materials on which images are formable and flexible enough to pass a fixer having a fixing roller. Specific example thereof include inorganic sheets such as metallic sheets, ceramic sheets and glass fibers; OHP sheets; resin films; and organic sheets such as sheet-shaped natural fibers and organic synthetic fibers.

After a toner image is formed on the substrate by an electrophotographic image forming apparatus mentioned later, a varnish is applied onto the toner image and cured by the above-mentioned curers to prepare a printed material having a varnished layer as a protection layer.

The toner image is formed on the substrate by an image former of the electrophotographic image forming apparatus, and the toner image is varnished by a varnish applicator thereof and dried by a dryer to form the varnish layer on the printed material.

Figure 4:
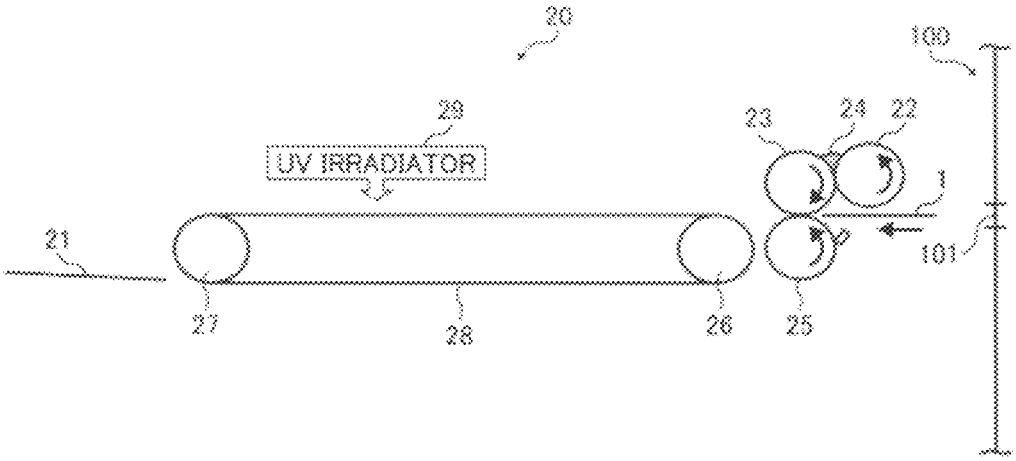
FIG. 4 is a schematic view illustrating a varnish applicator of an image forming apparatus.

Next, the image forming apparatus having a varnish applicator is explained, referring to FIG. 4.

The image forming apparatus of the present invention includes an image forming apparatus body 100 and a varnish applicator 20 as shown in FIG. 4.

The image forming apparatus body 100 forms a toner image on a substrate with a toner including a wax.

The varnish applicator 20 and a varnish application process therewith are explained.

The varnish is applicable at a proper time in the fixing process. The varnish is preferably coated on a substrate immediately after an image is formed, e.g., by an inline coater printing and overcoating by the same printing device. Alternatively, the varnish may be coated on a substrate at a short or a long interval after an image is formed, e.g., by an offline coater printing and overcoating by different printing devices. Further, a varnish 24 can be coated on the whole of s substrate 1, the whole of an image, a part of the substrate or a part of the image. A printed material, the surface of which is protected or glossed by the varnish is provided. The substrate used for the printed material is just electrophotographically image-formable, and its weight and size are not particularly limited. The varnish applicator can have the drier.

The varnished can be coated by roll coaters, flex coaters, rod coaters, blades, wire bars, air knives, curtain coaters, slide coaters, doctor knives, screen coaters, gravure coaters (such as offset gravure coaters), slot coaters, extrusion coaters, and liquid film coaters including inkjet coaters. These coaters can be used in known methods such as normal and reverse roll coating methods, offset gravure coating methods, curtain coating methods, lithographic coating methods, screen coating methods, gravure coating methods and inkjet coating methods.

The varnish applicator 20 used in the image forming apparatus of the present invention is explained, referring to FIG. 4. FIG. 4 is a schematic view illustrating the varnish applicator. As FIG. 4 shows, the varnish applicator 20 includes a metallic roller 22 controlling an amount of the varnish adhering to a substrate and smoothing the varnish adhering thereto, a varnish application roller 23 contacting the metallic roller 22 to rotate, a pressure roller 25 (e.g., metallic) contacting the varnish application roller 23 to rotate, a feed belt 28 wound around a feed rollers 26 and 27, and an UV irradiator 29. The substrate 1 a toner image is formed on by the image forming apparatus body 100 is output from a paper discharge opening 101. When the substrate 1 passes between the rollers 23 and 25 with the toner image side up, the varnish 24 fed between the rollers 22 and 23 is coated on the surface thereof. Then, the substrate 1 is fed by the feed belt 28, the coated varnish 24 is dried by the UV irradiator 29 as a drier, and discharged on a tray 21.

The varnish applicator 20 may be equipped in the image forming apparatus body 100 as an option, and may be used alone.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

A weight and an average molecular weight of isoparaffin or cycloparaffin were measured by FD (Field Desorption) methods with JMS-T100GC"AccuTOF GC" from JEOL, Ltd.

Example 1

The following materials were kneaded at 120° C. by a biaxial extruder to prepare a kneaded mixture.

| | |
|---|---|
| Polyester resin (having weight-average molecular weight of 68,200 and a glass transition temperature (Tg) of 65.5° C.) | 89 |
| Petroleum wax | 5 |
| Isoparaffin (having an average molecular weight of 650) | 0.75 (15% by weight of the total weight of the petroleum wax) |
| Carbon black (#44 from Mitsubishi Chemical Corp.) | 5 |
| Charge Controlling Agent (TRH from HODOGAYA CHEMICAL CO., LTD.) | 1 |

The kneaded mixture was cooled, pulverized by an airstream pulverizer, and classified into mother particles having an weight-average particle diameter of 11.0 μm. 2.2% by weight of silica (R-972 from Nippon Aerosil Co., Ltd) were externally mixed with the mother particles to prepare a toner 1.

The toner had a circularity of 0.90 and a volume-average particle diameter of 8 μm.

A particulate magnetite having an average particle diameter of 50 μm was coated with a silicon resin to have a layer thickness of 0.5 μm to prepare a carrier. The carrier was mixed with the toner such that the toner had a concentration of 5.0% by weight to prepare a developer.

Thirty (30) parts of pentaerythritoltetraacrylate, 66 parts of trimethylolpropanetriacrylate, and further 0.3 parts of a polymerization inhibitor hydroquinone were placed in a beaker, and heated while stirred to have a temperature of 120° C. and diallylphthalate prepolymer was dissolved in the resultant mixture. Further, 2 parts of aluminum isopropylate dispersed in 2 parts of toluene were gradually added therein, and the mixture was stirred for 20 min at 110° C. Meanwhile, the toluene was removed to prepare a light-curing varnish base agent.

Further, 75 parts of the light-curing varnish base agent, 10 parts of benzophenone as a sensitizer, 5 parts of p-dimethylaminoacetophenone as a photopolymerization initiator and 10 parts of phenylglycolacrylate as an ink viscosity conditioner were mixed and kneaded by a three-roll mil to prepare a light-curing varnish.

Example 2

The procedure for preparation of the toner 1 in Example 1 was repeated to prepare a toner 2 having the same circularity and volume-average particle diameter as those of the toner 1 except for replacing the isoparaffin with isoparaffin having an average molecular weight of 2,050 in an amount of 45% by weight of the total weight of the petroleum wax. In addition, the procedure for preparation of the developer in Example 1 was repeated to prepare a developer except for replacing the toner 1 with the toner 2.

The varnish 1 was used.

Example 3

The procedure for preparation of the toner 1 in Example 1 was repeated to prepare a toner 3 having the same circularity and volume-average particle diameter as those of the toner 1 except for replacing the isoparaffin with isoparaffin having an average molecular weight of 520 in an amount of 8% by weight of the total weight of the petroleum wax. In addition, the procedure for preparation of the developer in Example 1 was repeated to prepare a developer except for replacing the toner 1 with the toner 3.

The varnish 1 was used.

Example 4

The procedure for preparation of the toner 1 in Example 1 was repeated to prepare a toner 4 having the same circularity and volume-average particle diameter as those of the toner 1 except for replacing the isoparaffin with isoparaffin having an average molecular weight of 470 in an amount of 11% by weight of the total weight of the petroleum wax. In addition, the procedure for preparation of the developer in Example 1 was repeated to prepare a developer except for replacing the toner 1 with the toner 4.

The varnish 1 was used.

Example 5

The toner 1 was used.

The following materials were mixed to prepare an aqueous varnish 5.

| | |
|---|---|
| Acrylic emulsion (JONCRYL 352 from Johnson Polymer LLC) | 25 |
| Acrylic emulsion (JONCRYL 741 from Johnson Polymer LLC) | 52 |
| Acrylic aqueous solution (JONCRYL 60 from Johnson Polymer LLC) | 14 |
| Ethyleneglycol monobutylether acetate | 3 |
| Water | 5 |

Example 6

The toner 1 was used.

One hundred (100) parts of marketed CARTON CELF GW varnish from Dainippon Ink And Chemicals, Incorporated were used. The varnish is formed of rosin-modified phenol resin varnish, polymerized linseed oil, light oil and auxiliary agents such as driers and film stiffeners.

Example 7

The toner 1 was used.

The procedure for preparation of the varnish 1 in Example 1 was repeated to prepare a varnish 7 except for using 70 parts of the light-curing varnish base agent instead of 75 parts thereof and adding 5 parts of polyoxyethyleneglycolalkylether as a surfactant.

Example 8

The toner 1 was used.

The procedure for preparation of the varnish 5 in Example 5 was repeated to prepare a varnish 8 except for replacing JONCRYL 352, JONCRYL 741 and JONCRYL 60 with 50 parts of JONCRYL 741, and adding 2 parts of dialkyl sodium sulfosuccinate (anion surfactant).

Example 9

The toner 1 was used.

The procedure for preparation of the varnish 6 in Example 6 was repeated to prepare a varnish 9 except for using 96 parts of CARTON CELF GW varnish instead of 10 parts thereof, and adding 4 parts of alkylbenzenesulfonate (anion surfactant).

Example 10

Synthesis of Unmodified (Low-Molecular-Weight) Polyester Resin

Sixty seven (67) parts of an adduct of bisphenol A with 2 moles of ethyleneoxide, 84 parts of an adduct of bisphenol A with 3 moles of propyleneoxide, 274 parts terephthalic acid and 2 parts of dibutyltinoxide were reacted in a reactor vessel including a cooling pipe, a stirrer and a nitrogen inlet pipe for 8 hrs at a normal pressure and 230° C.

Next, the mixture was depressurized by 10 to 15 mm Hg and reacted for 5 hrs to prepare an unmodified polyester resin. The unmodified polyester resin had a number-average molecular weight of 2,100, a weight-average molecular weight of 5,600, and a glass transition temperature (Tg) of 55° C.

—Preparation of Masterbatch (MB)—

One thousand (1,000) parts of water, 540 parts of carbon black Printex 35 from Degussa A. G. having a DBP oil absorption of 42 ml/100 mg and a pH of 9.5, 1,200 parts of the unmodified polyester resin were mixed by a Henschel Mixer from Mitsui Mining Co., Ltd.

After the mixture was kneaded by a two-roll mill having a surface temperature of 150° C. for 30 min, the mixture was extended by applying pressure, cooled and pulverized by a pulverizer from Hosokawa Micron Limited to prepare a masterbatch.

—Synthesis of Prepolymer—

Six hundred and eighty two (682) parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C.

Further, after the mixture was depressurized by 10 to 15 mm Hg and reacted for 5 hrs to prepare an intermediate polyester resin.

The intermediate polyester resin had a number-average molecular weight of 2,100, a weight-average molecular weight of 9,600, a Tg of 55° C. and an acid value of 0.5 mg KOH/g and a hydroxyl value of 49 mg KOH/g.

—Synthesis of Ketimine (Compound Including an Active Hydrogen Group)—

Thirty (30) parts of isophoronediamine and 75 parts of methyl ethyl ketone were reacted at 50° C. for 5 hrs in a reaction vessel including a stirrer and a thermometer to prepare a ketimine compound. The ketimine compound had an amine value of 423 mg KOH/g.

—Synthesis of Styrene-Acrylic Copolymer Resin—

In a reactor vessel including a cooling pipe, a stirrer and a nitrogen inlet pipe, 300 parts of ethylacetate, 300 parts of a mixture of styrene-acrylic monomer (styrene/2-ethylhexylacrylate/acrylate/2-hydroxyethylacrylate=75/15/5/5(weight ratio)) and 10 parts of bisazoisobutylnitrile were reacted with each other at 60° C. for 15 hrs in a nitrogen atmosphere.

Then, 200 parts of methanol were added to the reaction liquid and stirred for 1 hr, and then a supernatant thereof was removed and dried under reduced pressure to prepare a styrene-acrylic copolymer resin.

In a beaker, 10 parts of the prepolymer, 60 parts of the unmodified polyester, 130 parts of ethylacetate and 30 parts of the styrene-acrylic copolymer were stirred and dissolved. Then, 10 parts of isoparaffin having an average molecular weight of 650 nm and 10 parts of the masterbatch were dispersed by a beads mill (Ultra Visco Mill from IMECS CO., LTD.) for 3 passes at a liquid feeding speed of 1 kg/hr and a peripheral disc speed of 6 msec using zirconia beads having diameter of 0.5 mm for 80% by volume to prepare a material solution, and 2.7 parts of the ketimine were added to the solution to prepare a toner material solution/dispersion.

—Preparation of Aqueous Medium—

Three hundred and six (306) parts of ion-exchange water, 265 parts of a suspension liquid including tricalcium phosphate in an amount of 10% by weight, and 0.2 parts of sodium dodecylbenzenesulfonate were mixed while stirred such that the solid contents were uniformly dissolved to prepare an aqueous medium.

—Preparation of Emulsion or Dispersion, or Emulsified and Dispersed Liquid (Emulsified Slurry)—

One hundred and fifty (150) parts of the aqueous medium were placed in a container and stirred by T.K. Homomixer at 12,000 rpm, and 100 parts of the toner material solution/dispersion were added therein and nixed for 10 min to prepare an emulsified slurry.

—Removal of Organic Solvent—

One hundred (100) parts of the emulsified slurry were placed in a flask including a stirrer and a thermometer, and after a solvent was removed therefrom at 30° C. for 12 hrs while stirred at a peripheral speed of 20 m/min to prepare a dispersion slurry.

—Washing & Drying—

After 100 parts of the dispersion slurry was filtered under reduced pressure, 100 parts of ion-exchange water were added to the filtered cake and mixed by T.K. Homomixer at 12,000 rpm for 10 min, and the mixture was filtered.

Three hundred (300) parts of ion-exchange water were added to the filtered cake and mixed by T.K. Homomixer at 12,000 rpm for 10 min, and the mixture was filtered. This operation was repeated again.

Twenty (20) parts of aqueous sodium hydroxide having a concentration of 10% by weight were added to the filtered cake and mixed by T.K. Homomixer at 12,000 rpm for 30 min, and the mixture was filtered under reduced pressure.

Three hundred (300) parts of ion-exchange water were added to the filtered cake and mixed by T.K. Homomixer at 12,000 rpm for 10 min, and the mixture was filtered.

Three hundred (300) parts of ion-exchange water were added to the filtered cake and mixed by T.K. Homomixer at 12,000 rpm for 10 min, and the mixture was filtered. This operation was repeated again.

Twenty (20) parts of hydrochloric acid having a concentration of 10% by weight were added to the filtered cake and mixed by T.K. Homomixer at 12,000 rpm for 30 min, and the mixture was filtered.

Three hundred (300) parts of ion-exchange water were added to the filtered cake and mixed by T.K. Homomixer at 12,000 rpm for 10 min, and the mixture was filtered. This operation was repeated again to prepare a final filtered cake.

The final filtered cake was dried by an air drier at 45° C. for 48 hrs, and sieved with a mesh having an opening of 75 μm to prepare mother toner particles.

—External Additive—

Further, 0.6 parts of hydrophobic silica having an average particle diameter of 100 nm, 1.0 part of hydrophobized titanium oxide having an average particle diameter of 20 nm and 0.8 parts of hydrophobic silica fine powder having an average particle diameter of 15 nm were mixed with 100 parts of the mother toner particles by Henschel Mixer from Mitsui Mining Co. to prepare a toner 10.

The toner 10 had a weight-average particle diameter of 5.7 μm and an average circularity of 0.940.

—Carrier—

The following materials were dispersed by a homomixer for 10 min to prepare a solution for forming a coated film of an acrylic resin and a silicone resin including a particulate alumina.

| | |
|---|---|
| Acrylic resin solution (including a solid content of 50% by weight) | 21.0 |
| Guanamine solution (including a solid content of 70% by weight) | 6.4 |
| Particulate alumina (having a particle diameter of 0.3 μm and a resistivity of $10^{14}$ Ω · cm) | 7.6 |
| Silicone resin solution (including a solid content SR2410 of 23% by weight from Dow Corning Toray Silicone Co., Ltd.) | 65.0 |
| Amino silane (including a solid content SH6020 from Dow Corning Toray Silicone Co., Ltd.) | 0.3 |
| Toluene | 60 |
| Butyl cellosolve | 60 |

The solution for forming a coated film was coated on a calcined ferrite powder [$(MgO)_{1.8}(MnO)_{49.5}(Fe_2O_3)_{48.0}$ having an average particle diameter of 35 μm as a core material] by SPIRA COTA from OKADA SEIKO CO., LTD to have a thickness of 0.15 μm, and dried. The dried material was calcined in an electric oven at 150° C. for 1 hr. The calcined material was cooled and sieved with a sieve having an opening of 106 μm to prepare a carrier having a weight-average particle diameter of 35 μm.

Seven (7) parts of the toner 10 were uniformly mixed with 93 parts of the carrier and charged by Tubular Mixer rotating a container to prepare a developer.

The varnish 1 was used.

Example 11

The procedure for preparation of the toner 10 in Example 10 was repeated to prepare a toner 11 having the same circularity and volume-average particle diameter as those of the toner 10 except for replacing the isoparaffin with isoparaffin having an average molecular weight of 2,050 in an amount of 45% by weight of the total weight of the petroleum wax. In addition, the procedure for preparation of the developer in Example 10 was repeated to prepare a developer except for replacing the toner 10 with the toner 11.

The varnish 1 was used.

Example 12

The procedure for preparation of the toner 10 in Example 10 was repeated to prepare a toner 12 having the same circularity and volume-average particle diameter as those of the toner 10 except for replacing the isoparaffin with isoparaffin having an average molecular weight of 520 in an amount of 8% by weight of the total weight of the petroleum wax. In addition, the procedure for preparation of the developer in Example 10 was repeated to prepare a developer except for replacing the toner 10 with the toner 12.

The varnish 1 was used.

Example 13

The procedure for preparation of the toner 10 in Example 10 was repeated to prepare a toner 13 having the same circularity and volume-average particle diameter as those of the toner 10 except for replacing the isoparaffin with isoparaffin having an average molecular weight of 470 in an amount of 11% by weight of the total weight of the petroleum wax. In addition, the procedure for preparation of the developer in Example 10 was repeated to prepare a developer except for replacing the toner 10 with the toner 13.

The varnish 1 was used.

Examples 14 to 18

The toner 10 was used.

The varnishes 5 (Example 14) to 9 (Example 18) were used, respectively.

Comparative Examples 1 to 6

The procedure for preparation of the toner 1 in Example 1 was repeated to prepare a toner 21 having the same circularity and volume-average particle diameter as those of the toner 1 except for replacing the isoparaffin with isoparaffin having an average molecular weight of 400 in an amount of 2% by weight of the total weight of the petroleum wax. In addition, the procedure for preparation of the developer in Example 1 was repeated to prepare a developer except for replacing the toner 1 with the toner 21.

The varnishes 1 (Comparative Example 1) and 5 (Comparative Example 2) to 9 (Comparative Example 6) were used, respectively.

Comparative Examples 7 to 12

The procedure for preparation of the toner 10 in Example 10 was repeated to prepare a toner 22 having the same circularity and volume-average particle diameter as those of the toner 10 except for replacing the isoparaffin with isoparaffin having an average molecular weight of 400 in an amount of 2% by weight of the total weight of the petroleum wax. In addition, the procedure for preparation of the developer in Example 10 was repeated to prepare a developer except for replacing the toner 10 with the toner 22.

The varnishes 1 (Comparative Example 7) and 5 (Comparative Example 8) to 9 (Comparative Example 12) were used, respectively.

Printed materials were prepared using the toners and varnishes in Examples 1 to 18 and Comparative Examples 1 to 12 under the following conditions, and evaluated as follows. The results are shown in Table 1.

—Preparation of Printed Material—

An electrophotographic image was produced by imagio MP C7500 from Ricoh Company, Ltd on POD gloss coat weighing 128 g/m$^2$ from Oji Paper Co., Ltd. as a sheet substrate to prepare a printed material.

<Repelling (Wettability) Evaluation>

The varnish was coated on the printed material by UV varnish coater (SG610V) from Shinano Kenshi Co., Ltd. at 5 g/m$^2$. The light-curing varnish was cured by light irradiation from the coater, and the aqueous and oil varnishes were dried and cured in a chamber without light.

Varnish repelling of the printed material after the varnish was cured was visually evaluated under the following standard.

Very good: No repelling

Good: Almost no repelling

Poor: Slight repelling, but not problem

Very poor: Noticeable repelling

<Adhesiveness Evaluation>

The varnish was coated on the printed material by UV varnish coater (SG610V) from Shinano Kenshi Co., Ltd. at 5 g/m$^2$. The light-curing varnish was cured by light irradiation from the coater, and the aqueous and oil varnishes were dried and cured in a chamber without light. The varnish cured on the printed material was cut by a cutter knife on a grid of 100 cells at an interval of 1 mm, based on JIS K5400. The cells were peeled with a cellophane adhesive tape, and the number thereof which were not peeled off was counted to evaluate adhesiveness of the varnish layer.

Very good: 100/100

Good: 80-99/100

Poor: 40-79/100

Very poor: 0-39/100

TABLE 1

| | Toner | | | | Varnish | | | | | |
|---|---|---|---|---|---|---|---|---|---|---|
| | Toner | | | | Varn. | | Surf. | | ER | |
| | No. | IP Wt. % | AM | Part | No. | Type | Type | Part | Rep. | Ad. |
| Ex. 1 | 1 | 15 | 650 | 5 | 1 | LC | — | — | G | G |
| Ex. 2 | 2 | 45 | 2050 | 5 | 1 | LC | — | — | G | G |

TABLE 1-continued

| | Toner | | | | Varnish | | | | | |
|---|---|---|---|---|---|---|---|---|---|---|
| | Toner | | | | Varn. | | Surf. | | ER | |
| | No. | IP Wt. % | AM | Part | No. | Type | Type | Part | Rep. | Ad. |
| Ex. 3 | 3 | 8 | 520 | 5 | 1 | LC | — | — | P | P |
| Ex. 4 | 4 | 11 | 470 | 5 | 1 | LC | — | — | P | P |
| Ex. 5 | 1 | 15 | 650 | 5 | 5 | A | — | — | P | G |
| Ex. 6 | 1 | 15 | 650 | 5 | 6 | O | — | — | P | G |
| Ex. 7 | 1 | 15 | 650 | 5 | 7 | LC | POEG | 5 | VG | VG |
| Ex. 8 | 1 | 15 | 650 | 5 | 8 | A | DSSS | 2 | VG | VG |
| Ex. 9 | 1 | 15 | 650 | 5 | 9 | O | ABS | 4 | VG | VG |
| Ex. 10 | 10 | 15 | 650 | 23 | 1 | LC | — | — | G | G |
| Ex. 11 | 11 | 45 | 2050 | 5 | 1 | LC | — | — | G | G |
| Ex. 12 | 12 | 8 | 520 | 23 | 1 | LC | — | — | P | P |
| Ex. 13 | 13 | 11 | 470 | 23 | 1 | LC | — | — | P | P |
| Ex. 14 | 10 | 15 | 650 | 23 | 5 | A | — | — | P | G |
| Ex. 15 | 10 | 15 | 650 | 23 | 6 | O | — | — | P | G |
| Ex. 16 | 10 | 15 | 650 | 23 | 7 | LC | POEG | 5 | VG | VG |
| Ex. 17 | 10 | 15 | 650 | 23 | 8 | A | DSSS | 2 | VG | VG |
| Ex. 18 | 10 | 15 | 650 | 23 | 9 | O | ABS | 4 | VG | VG |
| Com. Ex. 1 | 21 | 2 | 400 | 5 | 1 | LC | — | — | VP | VP |
| Com. Ex. 2 | 21 | 2 | 400 | 5 | 5 | A | — | — | VP | VP |
| Com. Ex. 3 | 21 | 2 | 400 | 5 | 6 | O | — | — | VP | VP |
| Com. Ex. 4 | 21 | 2 | 400 | 5 | 7 | LC | POEG | 5 | VP | P |
| Com. Ex. 5 | 21 | 2 | 400 | 5 | 8 | A | DSSS | 2 | VP | P |
| Com. Ex. 6 | 21 | 2 | 400 | 5 | 9 | O | ABS | 4 | VP | P |
| Com. Ex. 7 | 22 | 2 | 400 | 23 | 1 | LC | — | — | VP | VP |
| Com. Ex. 8 | 22 | 2 | 400 | 23 | 5 | A | — | — | VP | VP |
| Com. Ex. 9 | 22 | 2 | 400 | 23 | 6 | O | — | — | VP | VP |
| Com. Ex. 10 | 22 | 2 | 400 | 23 | 7 | LC | POEG | 5 | VP | P |
| Com. Ex. 11 | 22 | 2 | 400 | 23 | 8 | A | DSSS | 2 | VP | P |
| Com. Ex. 12 | 22 | 2 | 400 | 23 | 9 | O | ABS | 4 | VP | P |

IP: isoparaffin
AM: average molecular weight
Varn.: varnish
Surf.: surfactant
ER: evalauation result
Rep.: repelling
Ad.: adhesiveness
LC: light curing
A: aqueous
O: oil
POEG: polyoxyethyleneglycol
DSSS: dialkyl sodium sulfosuccinate
ABS: alkylbenzenesulfonate
VG: very good
G: good
P: poor
VP: very poor Example 19

The procedure for preparation of the toner 1 in Example 1 was repeated to prepare a toner 1*c* having a circularity of 0.90 and a volume-average particle diameter of 8 μm except for replacing the isoparaffin with cycloparaffin having an average molecular weight of 650 in an amount of 15% by weight of the total weight of the petroleum wax. In addition, the procedure for preparation of the developer in Example 1 was repeated to prepare a developer except for replacing the toner 1 with the toner 1*c*.

The varnish 1 was used.

Example 20

The procedure for preparation of the toner 1*c* in Example 19 was repeated to prepare a toner 2*c* having the same circularity and volume-average particle diameter as those of the toner 1*c* except for replacing the cycloparaffin with cycloparaffin having an average molecular weight of 2,050 in an amount of 45% by weight of the total weight of the petroleum wax. In addition, the procedure for preparation of the developer in Example 19 was repeated to prepare a developer except for replacing the toner 1*c* with the toner 2*c*.

The varnish 1 was used.

Example 21

The procedure for preparation of the toner 1*c* in Example 19 was repeated to prepare a toner 3*c* having the same circularity and volume-average particle diameter as those of the toner 1*c* except for replacing the cycloparaffin with cycloparaffin having an average molecular weight of 520 in an amount of 8% by weight of the total weight of the petroleum wax. In addition, the procedure for preparation of the developer in Example 19 was repeated to prepare a developer except for replacing the toner 1*c* with the toner 3*c*.

The varnish 1 was used.

Example 22

The procedure for preparation of the toner 1*c* in Example 19 was repeated to prepare a toner 4*c* having the same circularity and volume-average particle diameter as those of the toner 1*c* except for replacing the cycloparaffin with cycloparaffin having an average molecular weight of 470 in an amount of 11% by weight of the total weight of the petroleum wax. In addition, the procedure for preparation of the developer in Example 19 was repeated to prepare a developer except for replacing the toner 1*c* with the toner 4*c*.

The varnish 1 was used.

Example 23

The toner 1*c* and the varnish 5 were used.

Example 24

The toner 1*c* and the varnish 6 were used.

Example 25

The toner 1*c* and the varnish 7 were used.

Example 26

The toner 1*c* and the varnish 8 were used.

Example 27

The toner 1*c* and the varnish 9 were used.

Example 28

The procedure for preparation of the toner 10 in Example 10 was repeated to prepare a toner 10*c* having a circularity 0.940 and a volume-average particle diameter of 5.7μ, except for replacing the isoparaffin with cycloparaffin having an average molecular weight of 650 in an amount of 15% by weight of the total weight of the petroleum wax. In addition, the procedure for preparation of the developer in Example 10 was repeated to prepare a developer except for replacing the toner 10 with the toner 10*c*.

The varnish 1 was used.

Example 29

The procedure for preparation of the toner 10*c* in Example 28 was repeated to prepare a toner 11*c* having the same circularity and volume-average particle diameter as those of the toner 10*c* except for replacing the cycloparaffin with cycloparaffin having an average molecular weight of 2,050 in an amount of 45% by weight of the total weight of the petroleum wax. In addition, the procedure for preparation of the developer in Example 28 was repeated to prepare a developer except for replacing the toner 10*c* with the toner 11*c*.

The varnish 1 was used.

Example 30

The procedure for preparation of the toner 10*c* in Example 28 was repeated to prepare a toner 12*c* having the same circularity and volume-average particle diameter as those of the toner 10*c* except for replacing the cycloparaffin with cycloparaffin having an average molecular weight of 520 in an amount of 8% by weight of the total weight of the petroleum wax. In addition, the procedure for preparation of the developer in Example 28 was repeated to prepare a developer except for replacing the toner 10*c* with the toner 12*c*.

The varnish 1 was used.

Example 31

The procedure for preparation of the toner 10*c* in Example 28 was repeated to prepare a toner 13*c* having the same circularity and volume-average particle diameter as those of the toner 10*c* except for replacing the cycloparaffin with cycloparaffin having an average molecular weight of 470 in an amount of 11% by weight of the total weight of the petroleum wax. In addition, the procedure for preparation of the developer in Example 28 was repeated to prepare a developer except for replacing the toner 10*c* with the toner 13*c*.

The varnish 1 was used.

Examples 32 to 36

The toner 10*c* and the varnishes 5 (Example 32) to 9 (Example 36) were used.

Comparative Examples 13 to 18

The procedure for preparation of the toner 1*c* in Example 19 was repeated to prepare a toner 21*c* having the same circularity and volume-average particle diameter as those of the toner 10*c* except for replacing the cycloparaffin with cycloparaffin having an average molecular weight of 400 in an amount of 2% by weight of the total weight of the petroleum wax. In addition, the procedure for preparation of the developer in Example 19 was repeated to prepare a developer except for replacing the toner 1*c* with the toner 21*c*.

The varnishes 1 (Comparative Example 13) and 5 (Comparative Example 14) to 9 (Comparative Example 18) were used.

Comparative Examples 19 to 24

The procedure for preparation of the toner 10*c* in Example 28 was repeated to prepare a toner 22*c* having the same circularity and volume-average particle diameter as those of the toner 10*c* except for replacing the cycloparaffin with cycloparaffin having an average molecular weight of 400 in an amount of 2% by weight of the total weight of the petroleum wax. In addition, the procedure for preparation of the developer in Example 19 was repeated to prepare a developer except for replacing the toner 10*c* with the toner 22*c*.

The varnishes 1 (Comparative Example 19) and 5 (Comparative Example 20) to 9 (Comparative Example 24) were used.

Printed materials were prepared using the toners and varnishes in Examples 19 to 36 and Comparative Examples 13 to 24 under the above-mentioned conditions, and evaluated as above. The results are shown in Table 2.

TABLE 2

| | Toner | | | | Varnish | | | | | |
|---|---|---|---|---|---|---|---|---|---|---|
| | Toner | | | | Varn. | | Surf. | | ER | |
| | No. | CP Wt. % | AM | Part | No. | Type | Type | Part | Rep. | Ad. |
| Ex. 19 | 1c | 15 | 650 | 5 | 1 | LC | — | — | G | G |
| Ex. 20 | 2c | 45 | 2050 | 5 | 1 | LC | — | — | G | G |
| Ex. 21 | 3c | 8 | 520 | 5 | 1 | LC | — | — | P | P |
| Ex. 22 | 4c | 11 | 470 | 5 | 1 | LC | — | — | P | P |
| Ex. 23 | 1c | 15 | 650 | 5 | 5 | A | — | — | P | G |
| Ex. 24 | 1c | 15 | 650 | 5 | 6 | O | — | — | P | G |
| Ex. 25 | 1c | 15 | 650 | 5 | 7 | LC | POEG | 5 | VG | VG |
| Ex. 26 | 1c | 15 | 650 | 5 | 8 | A | DSSS | 2 | VG | VG |
| Ex. 27 | 1c | 15 | 650 | 5 | 9 | O | ABS | 4 | VG | VG |
| Ex. 28 | 10c | 15 | 650 | 23 | 1 | LC | — | — | G | G |
| Ex. 29 | 11c | 45 | 2050 | 5 | 1 | LC | — | — | G | G |
| Ex. 30 | 12c | 8 | 520 | 23 | 1 | LC | — | — | P | P |
| Ex. 31 | 13c | 11 | 470 | 23 | 1 | LC | — | — | P | P |
| Ex. 32 | 10c | 15 | 650 | 23 | 5 | A | — | — | P | G |
| Ex. 33 | 10c | 15 | 650 | 23 | 6 | O | — | — | P | G |
| Ex. 34 | 10c | 15 | 650 | 23 | 7 | LC | POEG | 5 | VG | VG |
| Ex. 35 | 10c | 15 | 650 | 23 | 8 | A | DSSS | 2 | VG | VG |
| Ex. 36 | 10c | 15 | 650 | 23 | 9 | O | ABS | 4 | VG | VG |
| Com. Ex. 13 | 21c | 2 | 400 | 5 | 1 | LC | — | — | VP | VP |
| Com. Ex. 14 | 21c | 2 | 400 | 5 | 5 | A | — | — | VP | VP |
| Com. Ex. 15 | 21c | 2 | 400 | 5 | 6 | O | — | — | VP | VP |
| Com. Ex. 16 | 21c | 2 | 400 | 5 | 7 | LC | POEG | 5 | VP | P |
| Com. Ex. 17 | 21c | 2 | 400 | 5 | 8 | A | DSSS | 2 | VP | P |
| Com. Ex. 18 | 21c | 2 | 400 | 5 | 9 | O | ABS | 4 | VP | P |
| Com. Ex. 19 | 22c | 2 | 400 | 23 | 1 | LC | — | — | VP | VP |
| Com. Ex. 20 | 22c | 2 | 400 | 23 | 5 | A | — | — | VP | VP |
| Com. Ex. 21 | 22c | 2 | 400 | 23 | 6 | O | — | — | VP | VP |
| Com. Ex. 22 | 22c | 2 | 400 | 23 | 7 | LC | POEG | 5 | VP | P |
| Com. | 22c | 2 | 400 | 23 | 8 | A | DSSS | 2 | VP | P |

TABLE 2-continued

| | Toner | | | | Varnish | | | | | |
|---|---|---|---|---|---|---|---|---|---|---|
| | Toner | | | | Varn. | | Surf. | | ER | |
| | No. | CP Wt. % | AM | Part | No. | Type | Type | Part | Rep. | Ad. |
| Ex. 23 Com. Ex. 24 | 22c | 2 | 400 | 23 | 9 | O | ABS | 4 | VP | P |

CP: cycloparaffin
AM: average molecular weight
Varn.: varnish
Surf.: surfactant
ER: evaluation result
Rep.: repelling
Ad.: adhesiveness
LC: light curing
A: aqueous
O: oil
POEG: polyoxyethyleneglycol
DSSS: dialkyl sodium sulfosuccinate
ABS: alkylbenzenesulfonate
VG: very good
G: good
P: poor
VP: very poor

What is claimed as new and desired to be secured by Letters Patent of the United States is:

1. A printed material, comprising a substrate on which a toner image is formed with toner, wherein an oil varnish is coated on at least a part of the toner image to form a varnish layer thereon, wherein the toner comprises a petroleum wax, wherein the petroleum wax comprises a paraffin wax having a polarity, wherein the toner comprises the petroleum wax in an amount of from 3 to 30% by weight of the toner, and wherein the petroleum wax comprises isoparaffin or cycloparaffin in an amount not less than 10% by weight of the petroleum wax, and wherein the petroleum wax has a melting viscosity of from 10 to 100 cps at a temperature higher than a melting point by 20° C.

2. The printed material of claim 1, wherein the isoparaffin and the cycloparaffin have a molecular weight not less than 450.

3. The printed material of claim 1, wherein the varnish comprises a surfactant.

4. The printed material of claim 3, wherein the surfactant is one of an anionic surfactant, a nonionic surfactant, a silicone surfactant and a fluoro surfactant.

5. The printed material of claim 4, wherein the anionic surfactant is present and is one of a sulfosuccinate, disulfonate, ester phosphate, sulfate, sulfonate, and their mixtures.

6. The printed material of claim 4, wherein the nonionic surfactant is present and is one of a polyvinylalcohol, polyacrylate, isopropyl alcohol, acetylene diol, ethoxylated octylphenol, ethoxylated branched secondary alcohol, perfluorobutane sulfonate, and alkoxylated alcohol.

7. The printed material of claim 4, wherein the silicone surfactant is present and is a polyether decorated polydimethylsiloxane.

8. The printed material of claim 4, wherein the fluoro surfactant is present and is $F(CF_2CF_2)_m\ (CH_2CH_2O)_nH$, wherein m is from 1 to 7 and n is from 1 to 5.

9. The printed material of claim 1, wherein the petroleum wax comprises microcrystalline wax.

10. The printed material of claim 1, wherein the petroleum wax has a melting point of from 40 to 160° C.

11. A method of preparing printed materials, comprising:

forming a toner image on a substrate by an electrophotographic image forming apparatus with a toner; and forming an oil varnish layer on the toner image, wherein the toner comprises a petroleum wax, wherein the petroleum wax comprises a paraffin wax having a polarity, wherein the toner comprises the petroleum wax in an amount of from 3 to 30% by weight of the toner, and wherein the petroleum wax comprises isoparaffin or cycloparaffin in an amount not less than 10% by weight of the petroleum wax, and wherein the petroleum wax has a melting viscosity of from 10 to 100 cps at a temperature higher than a melting point by 20° C.

12. An image forming apparatus, comprising:

an image forming unit configured to form a toner image on a substrate with a toner; and a varnish applicator configured to apply an oil varnish on the substrate, wherein the toner comprises a petroleum wax, wherein the petroleum wax comprises a paraffin wax having a polarity, wherein the toner comprises the petroleum wax in an amount of from 3 to 30% by weight of the toner, and wherein the petroleum wax comprises isoparaffin or cycloparaffin in an amount not less than 10% by weight of the petroleum wax, and wherein the petroleum wax has a melting viscosity of from 10 to 100 cps at a temperature higher than a melting point by 20° C.

* * * * *